US005433099A

United States Patent [19]

Katsuhiro et al.

[11] Patent Number: 5,433,099

[45] Date of Patent: Jul. 18, 1995

[54] METHOD OF DRAW-FORMING A METAL SHEET HAVING AN ORGANIC FILM

[75] Inventors: Imazu Katsuhiro; Akira Kobayashi; Tomomi Kobayashi, all of Yokohama, Japan

[73] Assignee: Toyo Seikan Kaisha, Ltd., Tokyo, Japan

[21] Appl. No.: 255,808

[22] Filed: Jun. 7, 1994

Related U.S. Application Data

[63] Continuation of Ser. No. 955,015, Oct. 1, 1992, abandoned.

[30] Foreign Application Priority Data

Oct. 2, 1991 [JP] Japan ..... 3-255527

[51] Int. Cl.[6] ..... B21D 22/22

[52] U.S. Cl. ..... 72/347

[58] Field of Search ..... 72/347; 1/349, 350

[56] References Cited

U.S. PATENT DOCUMENTS

| | | | |
|---|---|---|---|
| 3,986,382 | 10/1976 | Miller et al. | 72/347 |
| 4,962,659 | 10/1990 | Imazu et al. | 72/349 |
| 5,014,536 | 5/1991 | Saunders | 72/350 |
| 5,048,317 | 9/1991 | Hirota et al. | 72/347 |

FOREIGN PATENT DOCUMENTS

| | | |
|---|---|---|
| 0410007 | 1/1991 | European Pat. Off. . |
| 0438774 | 7/1991 | European Pat. Off. . |
| 735158 | 5/1943 | Germany . |
| 2219543 | 12/1989 | United Kingdom . |

*Primary Examiner*—Lowell Larson
*Assistant Examiner*—Thomas C. Schoeffler
*Attorney, Agent, or Firm*—Sughrue, Mion, Zinn, Macpeak & Seas

[57] ABSTRACT

A draw-forming method in which a disc-like metal sheet having an organic film or a cup made of a metal sheet having an organic film is held by an annular holder member and a drawing die, and a drawing punch and the drawing die are moved in mesh with each other and relative to each other, the drawing punch being so provided as to move into or cut of the holder member in concentric with the holder member and the drawing die, wherein at least either one of the annular holder member or the drawing die that had been pushing a residual flange portion is so moved as to discontinue the pushing just before the draw forming is finished in said drawing step, and the flange portion is drawn while liberating the rear end of the flange portion. This makes it possible to eliminate the defects inherent in the conventional draw-forming method or the draw/redraw-forming method, and to draw-form a metal sheet having an organic film into a flangeless cup without developing pinching, film hair or enamel hair at the upper portion of the cup, without causing the can barrel or the organic film to be broken during the drawing, and without permitting the tools that are used to be worn out or damaged, but maintaining excellent operation efficiency.

4 Claims, 3 Drawing Sheets

(A)
(B)
(C)
DRAWING IS BEING CARRIED OUT
PRIOR METHOD
PRESENT INVENTION
1
2
3
4
5
6
7
10
11
12
13
14
C

TIMING CHART (PRESENT INVENTION)

METHOD OF DRAW-FORMING A METAL SHEET HAVING AN ORGANIC FILM

This is a Continuation of application Ser. No. 07/955,015 filed Oct. 1, 1992, now abandoned.

BACKGROUND OF THE INVENTION (1) Filed of the Invention

The present invention relates to a method of draw-forming a metal sheet having an organic film. More specifically, the invention relates to a method of stably producing drawn cans and, particularly, drawn/re-drawn cans without developing pinching, enamel hair or film hair at the time of draw-forming a metal sheet having an organic film, and without causing the drawn containers to be damaged or the tools to be worn out, but maintaining excellent produceability and formability.

(2) Description of the Prior Art

Seamless can barrels with bottom have long been produced in the field of producing cans by subjecting a metal sheet and, particularly, a metal sheet having an organic film to drawing or to drawing/redrawing.

The drawn cans or the drawn/redrawn cans have been produced by holding a metal sheet having an organic film using an annular holder member (often called blank holder) and a drawing die, moving the drawing die and a drawing punch relative to each other and in mesh with each other, the drawing punch being positioned so as to move in concentric relationship with the holder member and the redrawing die within the holder member, to thereby; draw-form the metal sheet with an organic film into a cup shape.

In the drawing/redrawing step, furthermore, a cup drawn from the metal sheet having an organic film through a preceding stage is held by an annular holder member that is inserted in the cup and by a redrawing die, and a redrawing punch and the redrawing die are moved in mesh with each other and relative to each other, the drawing punch being so provided as to move in concentric with the holder member and the redrawing die within the holder member, in order to obtain a deep-draw-formed cup having a diameter smaller than the cup drawn in the preceding stage.

In the step of redrawing, furthermore, a method has already been put into practice in which the radius of curvature of the redrawing die is sufficiently decreased to sufficiently increase the back tension that results from a combination of the holder member and the redrawing die, in order to decrease the thickness of the side wall portion of a final cup by bend-elongation (Japanese Laid-Open Patent Publication No. 258822/1989).

In draw-forming the metal sheet, in general, it is considered necessary to so form the cup that a flange is left whenever the draw-forming is carried out under the condition where a predetermined blank holding force is acting from the standpoint of preventing the formed cup from being wrinkled and producing cans having excellent shape and dimensional precision.

Under draw-forming conditions in which flanges remain in the formed cup, however, a limitation is imposed on the length of stroke of the punch as well as on the number of strokes of the punch per unit of time, i.e., on the speed of formation. It has therefore been desired not to have flanges remain, but rather to pull the flanges between the die, in order to enhance the rate of production.

In conventional draw formation or draw-redraw formation, the cup has been drawn with a predetermined blank holding force acting between the annular holder member and the drawing dies, i.e., to pull the flanges between the punch and the dies so that the flanges do not remain after drawing.

When the metal sheet having an organic film is drawn into a flanges cup, however there takes place a so-called selvage worn-out phenomenon (pinching) at the upper end of the cup or a phenomenon (film hair or enamel hair) in which the coating of the form of a film or enamel becomes like a waste of threads to cause damage compared to when the flanges are allowed to remain. In extreme cases, furthermore, the can barrel is broken or the organic film is broken during the drawing. Moreover, the tools that are used are subject to be worn out and damaged, and lose service life to a considerable degree.

When a cup drawn in the preceding stage is to be redrawn into a cup having a smaller diameter, in particular, the flanges remaining in the cup that is drawn in the preceding stage must be pulled into the plane of the holder member between the holder member and the redrawing die. Otherwise, the above-mentioned tendency appears conspicuously.

SUMMARY OF THE INVENTION

The object of the present invention therefore is to eliminate the above-mentioned defects inherent in the conventional draw-forming method or the draw/re-draw-forming method, and to provide a method of draw-forming a metal sheet having an organic film into a flanges cup without developing pinching, film hair, or enamel hair at the upper portion of the cup, without causing the can barrel or the organic film to be broken during the drawing, and without permitting the tools that are used to be worn out or damaged, but maintaining excellent operation efficiency.

According to the present invention, there is provided a draw-forming method in which a disc-like metal sheet having an organic film or a cup made of a metal sheet having an organic film is held by an annular holder member and a drawing die, and a drawing punch and the drawing die are moved in mesh with each other and relative to each other in a drawing step, the drawing punch being positioned so as to move into or out of the holder member in concentric relationship with the holder member and the drawing die, wherein at least either one of the annular holder member or the drawing die that had been pushing a residual flange portion of the metal sheet is moved as to discontinue the pushing just before the draw-forming is finished in said drawing step, and the flange portion is drawn while liberating a rear end of the flange portion.

According to the present invention, it is desired to draw the residual flange while maintaining a gap (C) between the annular holder member and the drawing die just before the completion of forming to be at least equal to the thickness (T) of the sheet being worked. It is further desired to draw the residual flanges by maintaining the lower limit of an average length of residual flanges (FlLs) when the rear end thereof is liberated to lie within a range that satisfies an equation (1), $$Rd < FlLs - H/2 - Tf \quad (1)$$

where Tf is a thickness of the sheet of the residual flange portion, Rd is a radius of curvature of the drawing die, and H is a height of selvage (height of mountain minus height of valley).

It is a widely known method to draw-form a cup from a disc-like metal sheet having an organic film by holding the disc-like metal sheet using an annular holder member and a drawing die and by moving a drawing punch and the drawing die in mesh with each other and relative to each other, the drawing punch being so provided as to move into and out of the holder member in concentric with the holder member and the drawing die. According to the method of the present invention, however, at least either one of the annular holder member or the drawing die that had been holding the residual flange portion is moved so as to discontinue the holding operation just before the draw-forming step is finished, and the flange portion is drawn while liberating the rear end of the flange portion.

In the draw-forming step, the metal sheet undergoes plastic flow in a manner so as to be stretched in the axial direction and contracted in the radial direction, and is thus formed into a cup having bottom. A metal sheet that is not placed under the tightly held condition is necessarily wrinkled due to the compressive force in the radial direction. In order to prevent this, the flat portion, i.e., the flange portion of the metal sheet that is being drawn-formed must be tightly held so that wrinkles will not develop. This operation is carried out by holding the metal sheet using the annular holder member and the drawing die in order to apply a predetermined pressing force or the blank holding force to the flange portion. This principle quite holds true even in the case of a metal sheet having an organic film.

However, when the metal sheet is drawn into a flangeless cup with the residual flange portion being held by the annular holding member and the drawing die, there develops pinching, film hair or enamel hair at the upper end of the cup. In extreme cases, therefore, the can barrel is broken or the organic film is broken during the drawing and, besides, the tools that are used are worn out or damaged. This is because in a press machine for draw forming that is commercially used, the blank holding force consists of a predetermined load. At a stage where the draw forming is just to be finished, however, the area of the residual flange portion that is in contact with the annular holder member and the drawing die decreases drastically, and the value of denominator that represents the pressure decreases. Therefore, the pressure exerted on the residual flange portion becomes very great correspondingly, and it is considered that the aforementioned defects develop due to this abnormal increase in the pressure. In a case of the metal sheet having an organic film, in particular, a portion that comes in contact with the annular holder member and the drawing die consists of a resin having rigidity smaller than that of the metal. Accordingly, stress is little scattered causing the above-mentioned defects to appear more distinctly.

According to the present invention, at least either one of the annular holder member or the drawing die that had been holding the residual flange portion is positively moved so as to discontinue the holding operation just before the draw-forming step is finished, enabling the flange portion to be drawn while liberating the rear end of the flange portion from the force of holding and making it possible to prevent the aforementioned pressure from abnormally rising. According to the present invention, therefore, the metal sheet having an organic film can be drawn into a flangeless cup without developing pinching, film hair, or enamel hair at the upper end of the cup, without causing the can barrel or the organic film to be broken during the drawing, and without permitting the tools that are used to be worn out or damaged, but maintaining excellent operation efficiency. Accordingly, production of the drawn containers can be enhanced.

As another means for suppressing the pressure from abnormally rising just before the drawing step is finished, it can be contrived to decrease the load that is applied between the annular holder member and the drawing die which are holding the residual flange portion. Such a means, however, makes the press mechanism of the draw-forming machine complex and is not practicable. According to the present invention, the annular holder member and the drawing die are so provided as to approach each other and to separate away from each other; i.e., the annular holder member and the drawing die are separated away from each other just before the draw-forming step is finished and the rear end of the residual flange portion is liberated to avoid the pressure from abnormally rising. Moreover, the gap between the annular holder member and the drawing die just before the completion of the draw-forming step can be easily adjusted by changing the timing chart of the crank mechanism in the pressing machine.

According to the present invention, the residual flange should be drawn while maintaining the gap (clearance: C) between the annular holder member and the drawing die just before the completion of the draw-forming step to be at least equal to the thickness (T) of the sheet that is to be worked. Furthermore, the lower limit of an average length of residual flanges (FlLs) of when the rear end thereof is liberated should be selected to satisfy the aforementioned equation (1). This prevents the valley portion of the flanges from overlapping the die radius, enabling the draw forming to be smoothly carried out.

That is, the gap C is naturally greater than the thickness of the sheet being worked, and its upper limit is allowed to be the radius Rd of curvature of the drawing die plus some margin ($\alpha$).

DETAILED DESCRIPTION OF THE INVENTION (Draw Forming)

Figure 1:
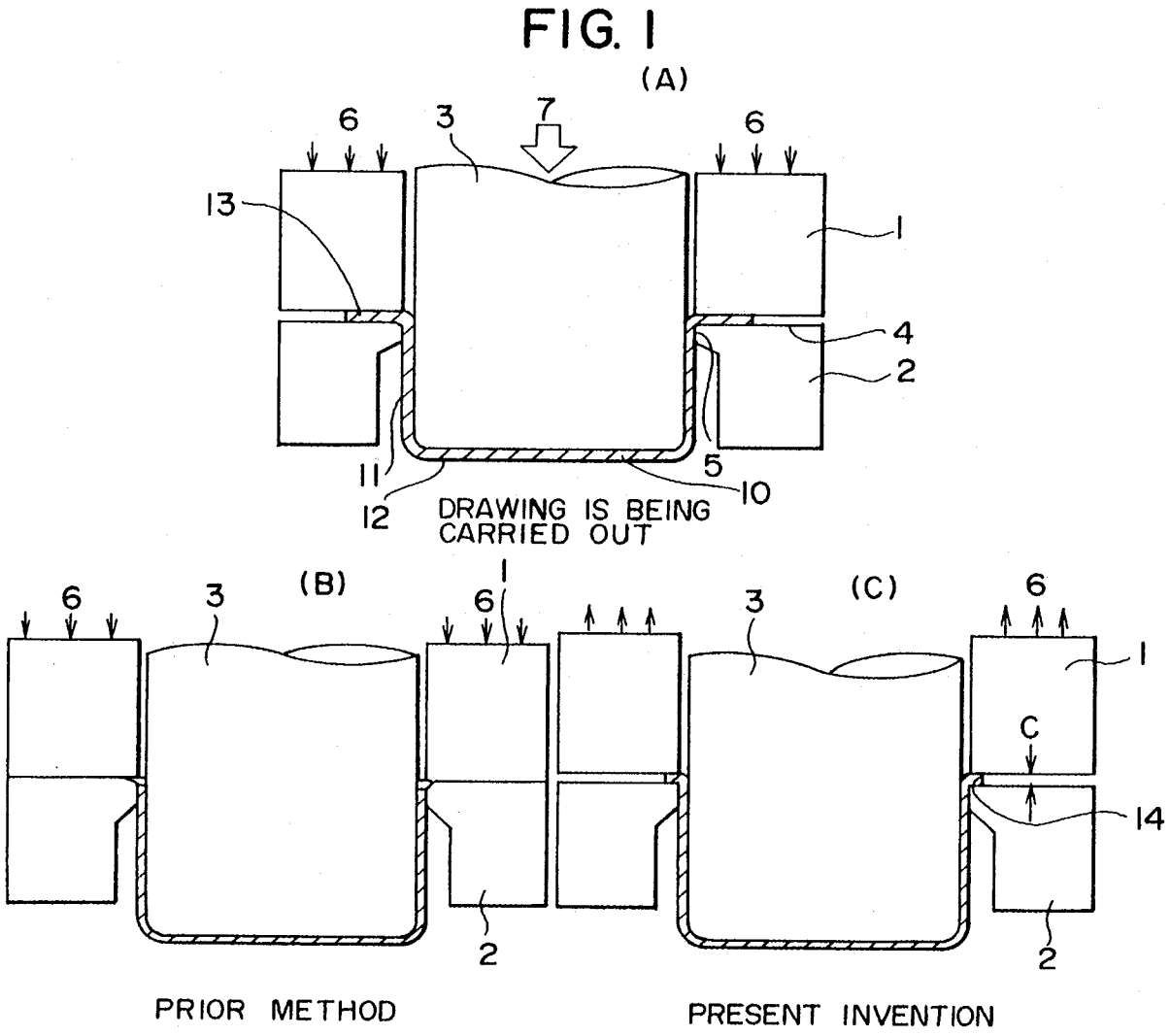
FIG. 1 is a diagram for explaining the draw-forming method according to the present invention, wherein the diagram (A) is a side sectional view of when the draw forming is being carried out, the diagram (B) is a side sectional view of just before the draw forming is finished according to a prior method, and the diagram (C) is a side sectional view of just before the draw forming is finished according to the present invention.

Referring to FIG. 1 which illustrates the draw-forming method of the present invention, the diagram (A) is a side sectional view of when the draw forming is being carried out, the diagram (B) is a side sectional view of just before the draw forming is finished according to a prior method, and the diagram (C) is a side sectional view of just before the draw forming is finished according to the present invention.

In FIG. 1, an annular holder member 1 and a drawing die 2 are so arranged as to approach each other and separate away from each other, and a drawing punch 3 is so provided as to move into and out of the holder member 1 and the drawing die 2 in concentric with the holder member and the drawing die. In this embodiment, the drawing die 2 remains fixed, and on the upper portion thereof are formed a flange-holding surface 4 and a working portion (corner portion) 5 for draw forming having a radius of curvature Rd on the upper and inner peripheral portion. The holder member 1 and the drawing punch 3 are connected to a crank mechanism of a press machine (which are not shown), and the holder member 1 applies a blank holding load 6 onto a metal sheet 10 having an organic film or onto the flange on the holding surface 4 of the drawing die. The drawing punch 3 applies a draw-forming load 7 onto the metal sheet 10 having an organic film inside the working portion 5 of the drawing die.

In FIG. 1(A) in which the draw forming is being carried out, the punch descends under the condition where the blank holding force is applied to the holder member 1, and the metal sheet 10 having an organic film is being formed into a cup which has a side wall 11, a bottom wall 12 and a residual flange 13 that is contiguous to the upper end of the side wall.

According to a prior method of FIG. 1(B) which shows the condition of just before the draw forming is finished, the punch 3 continues to descend with the blank holding force 6 being applied to the holder member 1 in order to form a cup without flange. Therefore, an abnormally increased pressure is applied to the rear end of the residual flange portion giving rise to the occurrence of such trouble as pinching, film hair or enamel hair.

According to the present invention of FIG. 1(C) which shows the condition of just before the draw forming is finished, the annular holder member 1 ascends just before the draw forming is finished, so that the rear end 14 of the residual flange portion is liberated from the blank holding force. This prevents an abnormally large pressure from being applied to the rear end 14, and the residual flange portion is smoothly pulled into between the drawing die 2 and the drawing punch 3, making it possible to produce a draw-formed cup free from the above-mentioned defects.

Figure 2:
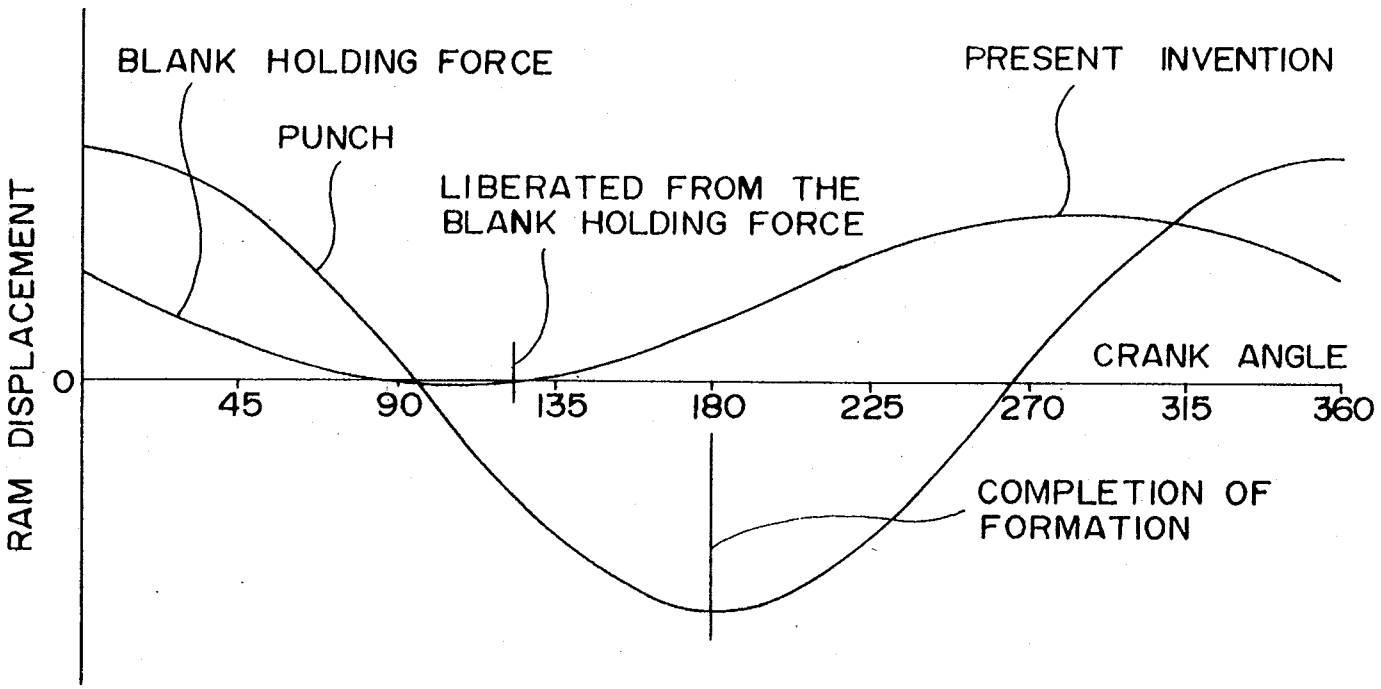
FIG 2 is a timing chart of a crank mechanism in a press machine employed in the present invention.

FIG. 2 is a timing chart of the crank mechanism of the press machine used in the present invention, wherein the abscissa represents the angle of the crank and the ordinate represents the ram displacement. A curve A represents the timing of the punch and a curve B represents the timing of the holder member. It will be understood from FIG. 2 that the holder member ascends before the stroke of the punch reaches the most descended position, enabling the residual flange portion to be liberated from the blank holding force.

In the present invention, the residual flange is liberated from the blank holding force of the holder member and the drawing die at a timing just before the draw forming is completed. If described more concretely, the lower limit thereof is defined by the equation (1). In general, it is preferred that the flange portion is liberated from the blank holding force at a point that lies within a range of from 65 to 98% and, particularly, that lies within a range of from 80 to 95% of the effective draw-forming stroke length. That is when the flange portion is liberated from the blank holding force too quickly, wrinkles tend to develop at the upper end of the draw-formed cup. When the flange portion is liberated from the blank holding force too late, on the other hand, enamel hair or film hair tends to develop.

The gap (clearance: C) between the annular holder member and the drawing die just before the draw forming is finished should lie within a range that satisfies the equation (2)

$$T \leqq C \leqq T + Rd + \alpha \qquad (2)$$

wherein T is a thickness of the sheet being worked, Rd is a radius of curvature of the drawing die, and $\alpha$ is a constant determined by the sheet being worked.

In the equation (2), Rd is a term that is related to the limit of wrinkle development when the residual flange is drawn, and the gap C can be increased with an increase in Rd.

The draw-forming method of the present invention can as a matter of course be adapted to the one stage of draw forming as well as to any stage of draw/redraw forming in which he drawing is carried out through a plurality of stages.

Described below is an example of a step for producing a draw-formed container of the present invention. In a punching step, first, the metal sheet having an organic film is punched into a disc. Next, in a pre-drawing step, the disc is drawn into a shallow-draw-formed cup having a bottom of a large diameter and a low side wall. Then, in a redrawing step, the shallow-draw-formed cup having a bottom of a large diameter and a low side wall. Then, in a redrawing step, the shallow-draw-formed cup is redrawn in accordance with a method shown in FIG. 1 of Japanese Laid-Open Patent Publication No. 258822/1989 to obtain a flange redrawn cup having a bottom of a diameter smaller than that of the shallow-draw-formed cup and having a side wall higher than that of the shallow-draw-formed cup. It is of course allowable to carry out the redrawing in two or more stages.

The draw ratio in the drawing step, i.e., a value defined by the equation (3), $$\text{Draw ratio} = \frac{\text{Blank diameter}}{\text{Diameter of drawn can}} \qquad (3)$$

should generally range from 1.2 to 1.9 and, particularly, from 1.3 to 1.8 per a stage of drawing, and should range from 2.0 to 4.0 and, particularly, from 2.0 to 3.5 in the case of a deep-draw-formed can as a whole.

In carrying out the draw forming or redraw forming, the metal sheet or the cup with an organic film should further be coated with various lubricating agents such as a liquid paraffin, a synthetic paraffin, an edible oil, a hydrogenated edible oil, palm oil, various natural waxes or a polyethylene wax. The lubricating agent is applied usually in an amount of 0.1 to 10 mg/dm$^2$ and, particularly, in an amount of 0.2 to 5 mg/dm$^2$ though it may vary depending upon the kind. The lubricating agent is spray-coated in a molten form onto the surface.

The draw forming can be carried out at room temperature but is desirably carried out usually at a temperature of from 20° C. to 95° C. and, particularly, from 20° C. to 90° C.

In carrying out the draw forming, the thickness of side wall of the cup can be decreased by bending in accordance with Japanese Laid-Open Patent Publication No. 258822/1989 or can be decreased by effecting the ironing working to a small degree.

(Metal Sheet having an Organic Film)

According to the present invention, a variety of surface-treated steel sheets and light metal sheets such as aluminum and the like can be used as metal sheets.

The surface-treated steel sheet may be the one that is obtained by annealing a cold-rolled steel plate, putting it to the secondary cold rolling, and then subjecting it to one or two or more kinds of surface treatment such as zinc plating, tin plating, nickel plating, electrolytic chromic acid treatment and chromic acid treatment. A preferred example of the surface-treated steel sheet is an electrolytically chromic acid-treated steel sheet having 10 to 200 mg/m$^2$ of a metal chromium layer and 1 to 50 mg/m$^2$ (reckoned as metal chromium) of chromium oxide layer because of its excellent film adhesiveness and corrosion resistance in combination. Another example of the surface-treated steel plate is a hard tin plate having tin plated in an amount of 0.5 to 11.2 g/m$^2$. It is desired that the tin plate is subjected to the treatment with chromic acid or with chromic acid/phosphoric acid such that the amount of chromium is from 1 to 30 mg/m reckoned as metal chromium. As a further example, there can be used an aluminum-coated steel sheet which is plated with aluminum or to which aluminum is press-adhered.

As light metal sheets, there can be used an aluminum alloy sheet in addition to a so-called pure aluminum sheet. The aluminum alloy sheet having excellent corrosion resistance and workability has a composition consisting of 0.2 to 1.5% by weight of manganese, 0.8 to 5% by weight of magnesium, 0.25 to 0.3% by weight of zinc, 0.15 to 0.25% by weight of copper, and the remainder of aluminum. It is desired that these light metal sheets are also subjected to the treatment with chromic acid or chromic acid/phosphoric acid such that the amount of chromium is 20 to 300 mg/m$^2$ reckoned as metal chromium.

The blank thickness (tB) or the metal sheet may vary depending upon the kind of metal, application of the container or the size thereof but should usually be from 0.10 to 0.50 mm. Among them, the thickness should range from 0.10 to 0.30 mm in the case of a surface-treated steel sheet and should range from 0.15 to 0.40 mm in the case of a light metal sheet.

According to the present invention, a protection film of an organic resin is applied to the metal sheet prior to draw-forming it, and the deep-draw forming and uniform reduction in the thickness of the side wall are carried out without substantially damaging the protection film. The protection film is formed by providing a protection coating or by laminating a thermoplastic resin film.

There can be used any protection coatings composed of thermosetting and thermoplastic resins. Examples include a modified epoxy coating such as a phenol-epoxy coating, amino-epoxy coating, etc.; a vinyl or a modified vinyl coating such as a vinyl chloride-vinyl acetate copolymer, a partly saponified product of vinyl chloride-vinyl acetate copolymer, a vinyl chloride-vinyl acetate-maleic anhydride copolymer, or epoxy-modified, epoxyamino-modified or epoxyphenol-modified vinyl coating; acrylic resin-type coating; or a synthetic rubber-type coating such as a styrene-butadiene-type copolymer, and the like which may be used alone or in a combination of two or more kinds.

These coatings are applied in the form of an organic solvent solution such as enamel or lacquer or in the form of an aqueous dispersion or an aqueous solution onto the metal blank in a manner of roller coating, spray coating, dip coating, electrostatic coating, or electrophoretic coating. When the resin coating has a thermosetting property, the coating is baked as required. From the standpoint of corrosion resistance and workability, it is desired that the protection coating usually has a thickness (in dry condition) of from 2 to 30 μm and, particularly, from 3 to 20 μm. In order to improve the drawability and redrawability, furthermore, the coating may contain a variety of lubricating agents.

Examples of the thermoplastic resin film that will be laminated include an olefin-type resin film such as a polyethylene, a polypropylene, an ethylene-propylene copolymer, an ethylene-vinyl acetate copolymer, an ethylene-acrylic ester copolymer, or an ionomer; a polyester film such as a polyethylene terephthalate, a polybutylene terephthalate, an ethylene terephthalate/isophthalate copolymer, an ethylene/butylene terephthalate/isophthalate copolymer, an ethylene terephthalate/isophthalate/adipate copolymer, etc.; a polyamide film such as nylon 6, nylon 6,6, nylon 11, nylon 12, etc.; a polyvinyl chloride film; and a polyvinylidene chloride film. These films may not have been stretched or may have been biaxially stretched. The thickness should generally range from 3 to 50 μm and, particularly, from 5 to 40 μm. The film is laminated on the metal sheet by thermal melt-adhesion method, dry lamination or extrusion coating method. When the adhesiveness (thermal melt-adhesiveness) is poor between the film and the metal sheet, there can be interposed, for example, an urethane-type adhesive agent, an epoxy-type adhesive agent, an acid-modified olefin resin-type adhesive agent, a copolymer-type adhesive agent, or a copolymer-type adhesive agent.

The coating or film used in the present invention may contain an inorganic filler (pigment) for the purpose of concealing the metal sheet or assisting the transmission of blank holding force to the metal sheet during the draw/redraw forming.

Examples of the inorganic filler include an inorganic white pigment such as a rutile-type or an anatase-type titanium doixide, zinc flower, gloss white or the like; a white body such as barite, precipitated barite sulfate, calcium carbonate, gypsum, precipitated silica, aerosil, talc, baked or unbaked clay, barium carbonate, alumina white, synthetic or natural mica, synthetic calcium silicate, or magnesium carbonate; a black pigment such as carbon black or magnetite; a red pigment such as red iron oxide; a yellow pigment such as sienna; and a blue pigment such as ultramarine or cobalt blue. These fillers can be blended in an amount of 10 to 50% by weight and, particularly, in an amount of 10 to 300% by weight with respect to the resin.

Figure 3:
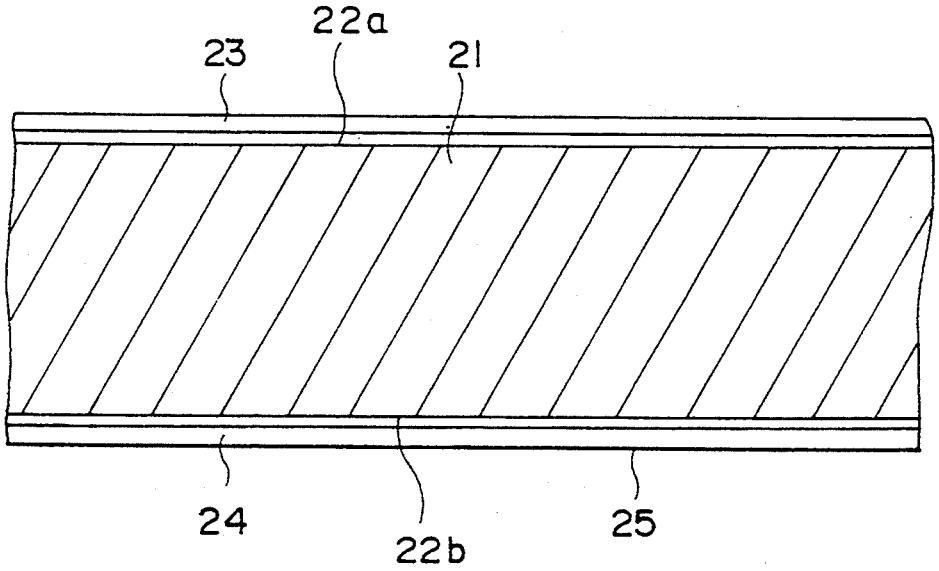
FIG. 3 is a sectional view of a metal sheet having a film that is favorably used in the present invention.

FIG. 3 shows a metal sheet having a film that is favorably used in the present invention. That is, formation films **22*a*, 22*b* such as chromic acid-treated films are formed on both surfaces of a metal substrate 21, and on the side that becomes the inner surface of the can is formed an inner surface film 23 consisting, for example, of a thermoplastic resin film via the formation film 22*a*. Furthermore, on the side that becomes the outer surface of the can is formed, via the formation film 22*b*, an outer surface film that consists of a white coating 24 and a transparent varnish 25**.

EXAMPLE

The invention will be described in further detail by way of the following working examples.

(Example 1)

A polyethylene terephthalate (PET) film having a thickness of 20 μm, a glass transition temperature of 70° C., a melting point of 255° C. was thermally stuck to both surfaces of a tin-free steel (TFS) having a blank thickness of 0.18 mm and a refining degree of DR-9 to form a metal sheet having a film which was then coated on both surfaces thereof with a lubricating agent and was subjected to the draw working under the following drawing conditions.

(Drawing Conditions)

A. Draw Working.

(1) Temperature for heating the metal sheet having a film: 80° C.

(2) Blank diameter: 187 mm (3) Draw ratio: 1.50

(4) Drawing die: fixed type having a radius of curvature of 1.5 mm (5) annular holder member: holding force liberation type (6) Gap C between the annular holder member and the drawing die just before the forming is finished: 0.4 mm (7) Average length FILs of residual flanges when application of blank holding force is discontinued: 4 mm (8) Blank holding force of the annular holder member until its application is discontinued: 3000 Kg (9) Mechanism of discontinuing the application of blank holding force: Timing chart of the crank mechanism is modified.

(10) Number of revolutions: 200 strokes per a minute

As a result, the draw working could be accomplished without developing pinching or film hair at the upper end of the drawn cup and without developing wrinkles on a portion that corresponds to the length of the residual flange. Furthermore, there was obtained a favorably drawn cup without damaging the barrel or without damaging the organic film that maintains container performance during the step of drawing.

Then, the primary to tertiary redraw workings were carried out under the following conditions.

B. Redraw Working

Primary redraw ratio: 1.29

Secondary redraw ratio: 1.24

Tertiary redraw ratio: 1.20

Radius of curvature of the redrawing die: 0.41 mm

Radius of curvature of the holding corner portion:. 1.0 mm

Blank holding load: 6000 Kg

The thus obtained deep-redraw-formed cup exhibited the following characteristics:

Diameter of cup: 66 mm

Height of cup: 140 mm

Rate of reduction in the thickness of side wall: −18%

Thereafter, the doming, trimming, dewaxing, neck-in and flange work were carried out according to a customary manner to obtain a can barrel for two-piece cans.

The degree of metal exposure was measured in order to check any damage on the organic protection film of the final can barrel. The enamel rater value in this case was smaller than 0.1 mA on the container as a whole which was on a good level. No abnormal condition was at all recognized from the organic protection film particularly on the upper portion of the container. The containers were cold-filled with coke and synthetic carbonated beverage, double wrap-seamed, and were preserved at 37° C. for three months to observe and evaluate corrosion on the inner surfaces of the containers. However, no problem was found and no abnormal condition was recognized in regard to the interface corrosion, either.

(Comparative Example 1)

The draw working was carried out in the same manner as in Example 1 except that the draw forming was performed without liberating the annular holder member just before the forming was finished but maintaining the annular holder member pushed onto the drawing die until the draw forming of the cup was finished.

As a result, pinching developed on the residual flange portion and the film hair developed throughout the whole circumference of the cup end, though they did not develop in Example 1.

Therefore, it was quite impossible to continuously form the cup, and large pinching and film hair resulted in the breakage of barrel and in extreme cases, the tools were often damaged.

Therefore, no cup was obtained that could be supplied to the redrawing in the next step.

(Comparative Example 2)

The draw working was carried out under the same conditions as in Example 1 with the exception of setting the gap C between the annular holder member and the drawing die to one-half (0.09 mm) the blank thickness just before the forming is finished. However, pinching developed in many number and, at the same time, barrel was broken so frequently, and it was quite impossible to carry out continuous formation.

(Comparative Example 3)

The draw working was carried out under the same conditions as in Example 1 with the exception of setting the gap C between the annular holder member and the drawing die to six times (1.08 mm) as great as the blank thickness just before the forming is finished. However, wrinkles developed throughout the whole residual flange portion, and the barrel was broken.

(Example 2)

The draw working was carried out under the same conditions as in Example 1 with the exception of using the blank having a thickness of 0.26 mm, setting the gap C between the annular holder member and the drawing die to be 0.6 mm just before the forming is finished, and selecting an average length FILs of residual flanges to be 6 mm at the time when the application of blank holding force is discontinued. The drawing could be conducted without generating pinching or film hair.

Furthermore, the cup could be formed without almost developing wrinkles at the upper end of the cup.

We claim:

1. A draw-forming method in which a flange portion of a disc-like metal sheet or a shallow cup made of a metal sheet is held in a gap between an annular holder member and a drawing die, and a drawing punch and the drawing die are relatively moved in engagement with each other, said drawing punch being so provided as to move into or out of the holder member in concentric relationship with the holder member and the drawing die, thereby to draw-form said disc-like metal sheet or said shallow cup into a draw-formed cup having a diameter smaller than the disc-like metal sheet or the shallow cup, wherein said disc-like metal sheet or said shallow cup has an organic film on the surface thereof and wherein draw-forming of the flange portion of the disc-like metal sheet or the shallow cup begins at a point of a draw-forming stroke length of the punch while being held in the gap between the annular member and the drawing die with a holding force sufficient to prevent the generation of wrinkles in the flange portion, and at a stroke point of 65 to 98% of the draw-forming stroke length of the punch the holding force is decreased to liberate the flange portion by adjusting the gap between the annular holder member and the drawing die to be at least equal to a thickness of the flange portion of the disc-like metal sheet or the shallow cup being worked, and draw-forming of the flange portion continues until the draw-forming stroke length of the punch is reached.

2. A draw-forming method according to claim 1, wherein the flange portion is drawn while maintaining a lower limit of an average length (FlLs) of the flange portion when the flange portion is liberated to lie within a range that satisfies the equation $$Rd < FlLs - H/2 - Tf$$

where Tf is the thickness of the flange portion, Rd is the radius of curvature of the drawing die, and H is the height of selvage (height of mountain minus height of valley).

3. A draw-forming method according to claim 1, wherein the organic film is composed of a thermoplastic resin.

4. A draw-forming method according to claim 1, wherein the organic film is composed of a thermosetting resin.

* * * * *